United States Patent [19]

Burke

[11] 4,182,496

[45] Jan. 8, 1980

[54] ACTUATOR BUTTON FOR FLUID DISPENSER

[75] Inventor: James E. Burke, Huntington, Conn.

[73] Assignee: Ethyl Products Company, Baton Rouge, La.

[21] Appl. No.: 861,310

[22] Filed: Dec. 16, 1977

[51] Int. Cl.[2] ..... B05B 11/04

[52] U.S. Cl. ..... 239/492; 222/402.11

[58] Field of Search ..... 239/492, 464, 533.12, 239/533.8, 602, 571, 579, 459, 117; 222/402.11, 494

[56] References Cited

U.S. PATENT DOCUMENTS

| | | | |
|---|---|---|---|
| 3,584,789 | 6/1971 | Traynor | 239/459 |
| 4,018,365 | 4/1977 | Batcher | 222/402.11 |
| 4,020,979 | 5/1977 | Shay et al. | 239/492 |

*Primary Examiner*—James B. Marbert

*Attorney, Agent, or Firm*—Donald L. Johnson; John F. Sieberth; David L. Ray

[57] ABSTRACT

An actuator button assembly for a finger-operated fluid dispenser including a compression chamber located in the actuator button, a piston slidably located in the compression chamber, an insert having an orifice therein fitted adjacent to the compression chamber, resilient means for biasing the piston toward the insert, and a cylindrical pin extending from the piston for contacting and sealing the orifice located in the insert.

10 Claims, 9 Drawing Figures

ACTUATOR BUTTON FOR FLUID DISPENSER

BACKGROUND OF THE INVENTION

The present invention relates to fluid dispensers. In particular, the invention relates to small, hand-held, finger-operated dispensers involving pump assemblages. However, if desired, the actuator button of the present invention could be placed on a finger-operated pressurized aerosol container.

It is known that the product dispensed from the spray orifice of commonly used finger-operated fluid dispensers frequently accumulates around the orifice causing clogging of the actuator button. Such clogging sometimes prevents fluids from being dispensed through the orifice.

SUMMARY OF THE INVENTION

In accordance with the present invention there is provided an actuator button assembly for a finger-operated fluid dispenser including an actuator button, a compression chamber, a a piston slidably located in the compression chamber, an insert fitted in the actuator button adjacent to the compression chamber, resilient means for biasing the piston toward the insert, and a cylindrical pin extending from the piston for contacting and sealing the orifice located in the insert.

BRIEF DESCRIPTION OF THE DRAWINGS

FIG. 1-A is an enlarged, cross-sectional view of the actuator button assembly in the depressed or dispensing position.

DESCRIPTION OF THE PREFERRED EMBODIMENTS

Figure 1A:
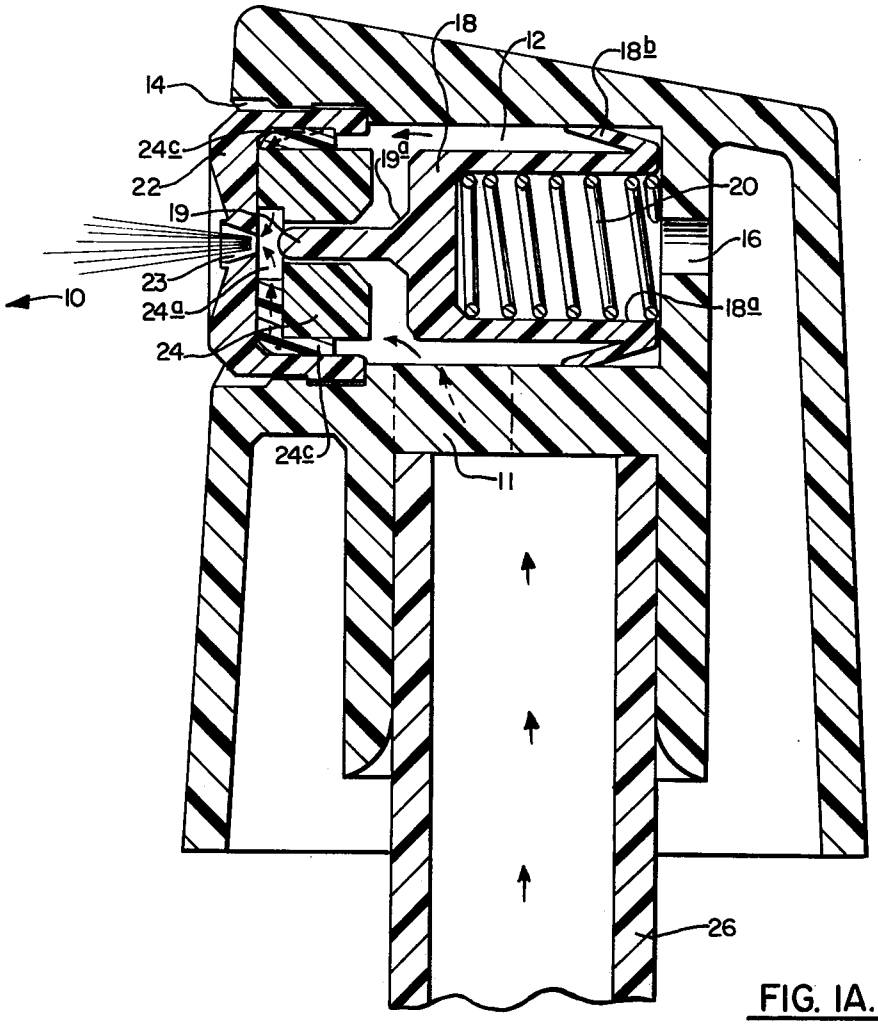
FIG. 1 is an enlarged cross-sectional view of the actuator button assembly in the raised or non-dispensing position.
Figure 1:
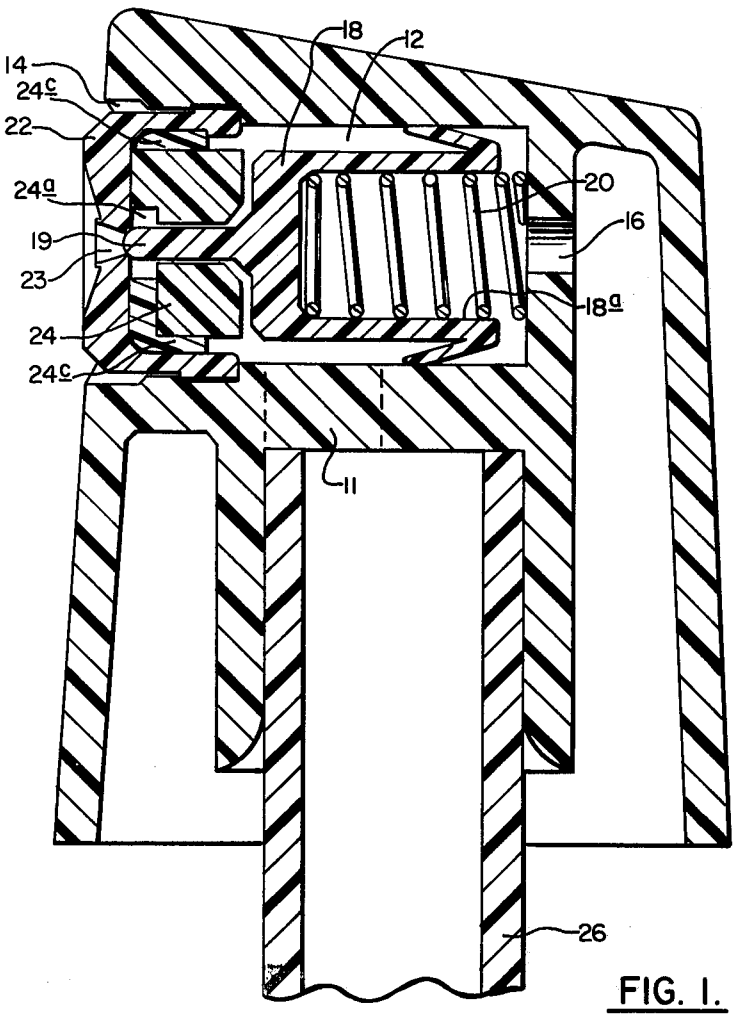
Figure 2:
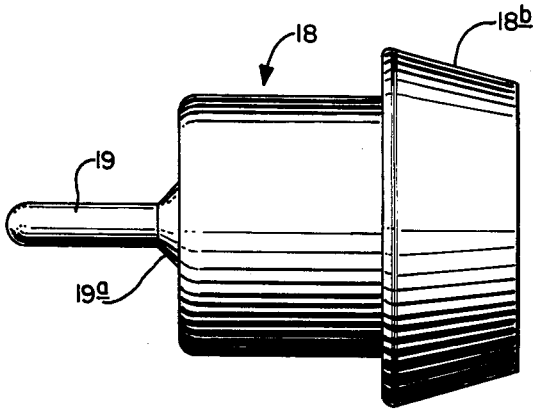
FIG. 2 is a side view of the piston located in the actuator button.
Figure 3:
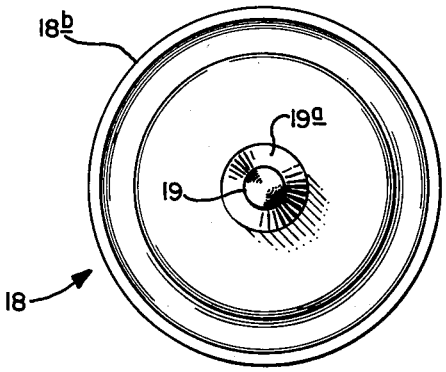
FIG. 3 is a front end view of the piston of FIG. 2.
Figure 4:
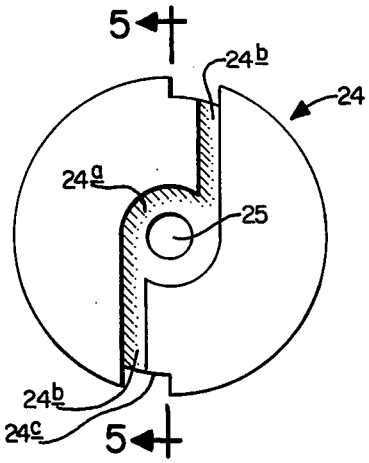
FIG. 4 is a front end view of the plug located in the actuator button.
Figure 5:
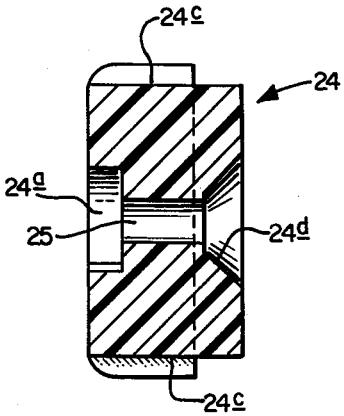
FIG. 5 is a cross-sectional view taken along lines 5—5 of FIG. 4.
Figure 6:
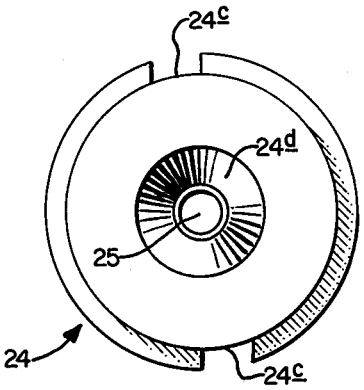
FIG.6 is a back end view of the plug located in the actuator button.
Figure 7:
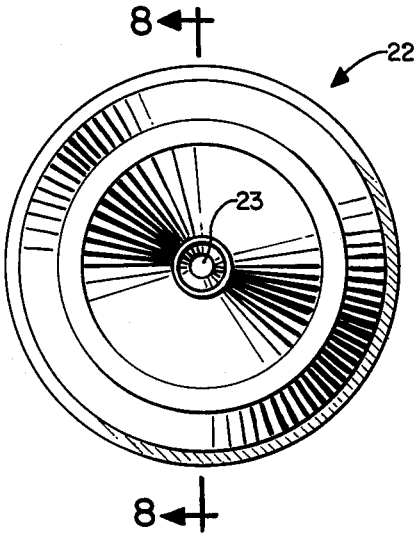
FIG. 7 is a front end view of the insert located in the actuator button.
Figure 8:
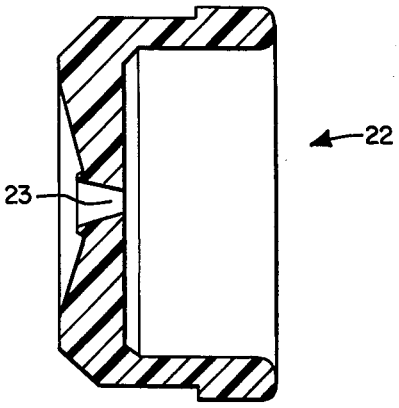
FIG. 8 is a cross-sectional view taken along lines 8—8 of FIG. 7.

Referring now to the drawings, the actuator button of the present invention can be seen in FIGS. 1 and 2 to be generally indicated by the numeral 10. Actuator button 10 is fitted onto a stem 26 which extends to a container (not shown) holding the fluid which is desired to be dispensed.

A conventional finger-operated pump such as the pump disclosed in U.S. Pat. No. Re. 28,366 can be connected to the lower end of stem 26 to the actuator button when the actuator button is depressed. If desired, the actuator button assembly can be attached to a pressurized aerosol container stem which supplies fluids under pressure to the button assembly when the button is depressed.

Actuator button 10 can be seen to include a cylindrical compression chamber 12 in which a piston generally indicated by the numeral 18 is slidably contained. In a larger chamber 14 located downstream and adjacent to compression chamber 12 is fitted insert 22 having orifice 23 through which dispensed fluids exit as shown in FIG. 1A. Fitted inside insert 22 is plug 24 into which extends a pin 19 for sealing orifice 23. Spring 20 biases piston 18 towards orifice 23.

When the actuator button is depressed, as shown in FIG. 1A, fluid from the container travels upward through stem 26 in the manner indicated by the arrows and into compression chamber 12 through inlet 11 which is an opening molded into actuator button 10. Air contained in the interior of piston 18 into which spring 20 is fitted exits to the atmosphere through vent 16 molded into actuator button 10.

As can be seen in FIGS. 1, 1A, 2, and 3, piston 18 has a cylindrical pin 19 extending therefrom. Preferably, pin 19 has a tapered base 19*a* for added strength, although the tapered base may be omitted if desired. A hollow cylindrical chamber 18*a* is located inside the piston 18 for receipt of spring 20. At one end of piston 18 is located scaling collar 18*b* which makes a sliding contact with the interior walls of compression chamber 12 and prevents fluids from flowing around piston 18 and out vent 16.

Slidably fitted in chamber 14 is insert 22 as can be seen in FIGS. 1, 1A, 7, and 8. Insert 22 contains an orifice 23 through which fluids exit when the actuator button 10 is depressed. Orifice 23 is contacted and sealed by pin 19 when the actuator button is moving upward or is at rest and the pressure drops in compression chamber 12. Pin 19 forms a tight seal with orifice 23 to prevent any material from drying on the inside of the orifice 23 and clogging the orifice. No air can enter the actuator button through orifice 23 due to the seal effected by pin 19.

Plug 24 is preferably fitted inside of insert 22. Plug 24 can be seen in FIGS. 1, 1A, and 4 through 6. Plug 24 is generally cylindrical in shape and contains a central opening 25 for receipt of pin 19.

Surrounding opening 25 on the downstream end of plug 24 is swirl chamber 24*a*. Extending radially outward from swirl chamber 24*a* are a series of fluid inlet channels 24*b* which communicate with longitudinal channels 24*c*. On the upstream end of plug 24 is a tapered inlet 24*d* communicating with opening 25 for receipt of tapered base 19*a* and pin 19.

Thus, fluid being dispensed from the actuator button as shown in FIG. 1A enters compression chamber 12 as indicated by the arrows in FIG. 1A, continues onward through inlet channels 24*c* and 24*b* to converge in swirl chamber 24*a* and exit through orifice 23. If desired, plug 24 could be omitted. Furthermore, if desired, a swirl chamber could be molded as one piece with insert 22, thereby eliminating plug 24.

Pin 19 is normally sealing compression chamber 12 from outside air when the actuator button 10 is not depressed. When actuator button 10 is actuated and pressure is transmitted from the container through stem 26, piston 18 is forced back against spring 20 and pin 19 is pulled away from its sealing position against orifice 23, thereby exposing orifice 23 to the pressurized fluids to be dispensed. Orifice 23 remains open and allows fluids to be discharged until the pressure in compression chamber 12 drops sufficiently for spring 22 to move the piston 18 and pin 19 to seal orifice 23.

Having fully described the invention, it is desired that it be limited only within the spirit and scope of the attached claims.

1. A pressure operated actuator button assembly for a finger operated fluid dispenser comprising:

a. an actuator button having:

i. a generally cylindrical compression chamber means having two ends;

ii. inlet channel means communicating with said compression chamber means for conveying pressurized fluids to be dispensed to said compression chamber means;

b. an orifice located in one of said ends of said compression chamber means through which fluids exit from said compression chamber means to the atmosphere;

c. piston means slidably received in said compression chamber means, said piston means having pin means for sealing said orifice and scaling collar means slidably received in said compression chamber means for containing fluids to be dispensed in said compression chamber means between said scaling collar means and said orifice; and d. resilient means for biasing said piston means towards said orifice and for allowing said piston means and said pin means to slide away from said end of said compression chamber means containing said orifice when fluids under sufficient pressure are conveyed to said compression chamber means through said inlet means to allow fluids to be dispensed through said orifice.

2. The assembly of claim 1 wherein plug means is fitted in said insert means, said plug means containing swirl chamber means for inducing turbulence in said fluids being dispensed prior to said fluid exiting from said orifice means.

3. The assembly of claim 2 wherein said plug means contains opening means for slidably receiving said pin means.

4. The assembly of claim 3 wherein said opening means of said plug means is aligned with said swirl chamber means to allow said pin means to extend into said swirl chamber means and seal said orifice means.

5. The assembly of claim 4 wherein said plug means has a tapered chamber communicating with said opening means on said upstream end of said plug means for slidable receipt of tapered base means on said pin means.

6. The assembly of claim 1 wherein said pin means is connected to said piston means by tapered base means.

7. The assembly of claim 1 wherein said actuator button means is adapted for slidably fitting onto stem means connected to container means.

8. The assembly of claim 1 wherein said actuator button contains vent means for permitting air to exit and enter said compression chamber means as said piston means slides in said compression chamber means.

9. The assembly of claim 8 wherein swirl chamber means is located adjacent to said orifice means.

10. The actuator button assembly of claim 1 wherein said orifice is located in an insert means fitted in one end of said chamber means.

* * * * *